US007604234B2

(12) United States Patent
Cutrofello

(10) Patent No.: US 7,604,234 B2
(45) Date of Patent: Oct. 20, 2009

(54) GEAR PUZZLE

(76) Inventor: Thomas Cutrofello, 37 - 75 65th St., Apt 22, Woodside, NY (US) 11377

( * ) Notice: Subject to any disclaimer, the term of this patent is extended or adjusted under 35 U.S.C. 154(b) by 52 days.

(21) Appl. No.: 11/707,675

(22) Filed: Feb. 15, 2007

(65) Prior Publication Data

US 2008/0197568 A1 Aug. 21, 2008

(51) Int. Cl.
*A63F 9/08* (2006.01)

(52) U.S. Cl. ..... 273/153 S

(58) Field of Classification Search ..... 273/153 S, 273/153 R, 155

See application file for complete search history.

(56) References Cited

U.S. PATENT DOCUMENTS

| | | | | | |
|---|---|---|---|---|---|
| 332,211 | A | | 12/1885 | Protheroe | |
| 560,197 | A | * | 5/1896 | Dow | 273/153 S |
| 564,022 | A | * | 7/1896 | Murphy | 273/153 S |
| 590,093 | A | * | 9/1897 | Du Bois | 273/153 S |
| 814,653 | A | * | 3/1906 | Healey | 273/153 S |
| 908,410 | A | * | 12/1908 | Jensen | 273/153 S |
| 1,132,430 | A | * | 3/1915 | Brogan et al. | 273/153 S |
| 1,444,654 | A | * | 2/1923 | Bradbury | 273/153 S |
| 1,560,921 | A | * | 11/1925 | Von Bultzingslowen | 273/153 S |
| 2,095,046 | A | * | 10/1937 | Wilner | 273/153 R |
| 2,219,841 | A | * | 10/1940 | Harless | 273/153 S |
| 4,468,033 | A | * | 8/1984 | Minami et al. | 273/153 S |
| 4,871,173 | A | | 10/1989 | Lammertink | |
| 5,622,368 | A | | 4/1997 | Chang | |
| 7,243,918 | B2 | * | 7/2007 | Vernon | 273/153 S |

* cited by examiner

*Primary Examiner*—Steven Wong
(74) *Attorney, Agent, or Firm*—Jordan and Hamburg LLP

(57) ABSTRACT

A game is provided which includes a body, a track disposed in the body, and tokens disposed in the track. The tokens are capable of translating in the track. A plurality of track portions are provided which include first, second and third track portions. Each of the plurality of portions is capable of receiving at least two tokens. A plurality of turntables is provided including first and second turntables rotatively connected to respective ones of the first and second portions. The turntables are rotatively coupled so that rotation of the first turntable rotates both the first portion and second turntable. Thereby, rotating the second track portion is automatically provided and simultaneous reversing of the order of tokens in each of the first and second track portions is provided.

20 Claims, 2 Drawing Sheets

GEAR PUZZLE

BACKGROUND OF THE INVENTION

Token filled track games have been known and used for some time. U.S. Pat. No. 332,211 to Protheroe, granted on Dec. 8, 1885, is directed to a "Puzzle", which is incorporated herein by reference. One embodiment of Protheroe provides a circular or endless track on which blocks can be moved. The top surface of each block is positioned level with a top surface of the body and the blocks are provided with a cross sectional shape to ensure they remain in the track. Followers are provided to ensure that the blocks move as a continuous train.

Protheroe provides a plurality of turntables along the track path, each having an turntable track that diametrically extends across the respective turntable. Each turntable is circumferentially spaced from each other turntable, where each turntable has a knob to enable individual rotation of the respective turntable.

U.S. Pat. No. 4,871,173 to Lammertink, granted Oct. 3, 1989, is directed to a "Puzzle or Game Having Token Filled Track and Turntable", which is incorporated herein by reference. The patent provides a block body with a top planar surface. An oval track having two linear portions and two outer annular portions are connected to form an infinite loop.

Disposed in the track is a plurality of tokens such that the top surface of the tokens is planar with the top surface of the block body. Each token has a cylindrical cross sectional shape that includes an annular step in the diameter at a point below the top surface of the token. A matching cross sectional shape is provided in the track so that each token remains within the track.

In one of the linear portions of the track path, a turntable is provided. The turntable has a cross section similar to that of the tokens and the block body has a cross sectional shape adapted for receiving the turntable. Once seated, the turntable remains capable of rotating but incapable of translating in the body. The turntable can receive a plurality of tokens in a turntable track and the turntable is capable of being rotated for reversing the order of the tokens disposed on the turntable relative to the remaining tokens on the track.

U.S. Pat. No. 5,622,368 to Clang, granted Apr. 22, 1997, is directed to a "Puzzle Disc", which is incorporated herein by reference, Chang provides a game similar to that of Lammertink but further includes plural opposing slots in which adjusting movable elements are stored.

In view of the above games, it is an object of the invention to increase the enjoyment of the game player by providing plural turntables having coupled motion in the track path.

BRIEF SUMMARY OF THE INVENTION

A game is provided which includes a body, a track disposed in the body, and tokens disposed in the track. The tokens are capable of translating in the track. A plurality of track portions are provided which include first, second and third track portions. Each of the plurality of portions is capable of receiving at least two tokens. A plurality of turntables is provided including first and second turntables rotatively connected to respective ones of the first and second portions. The turntables are rotatively coupled so that rotation of the first turntable rotates both the first portion and second turntable. Thereby, rotating the second track portion is automatically provided and simultaneous reversing of the order of tokens in each of the first and second track portions is provided.

BRIEF DESCRIPTION OF THE DRAWINGS

Accompanying the specification are figures which assist in illustrating the embodiments of the invention, in which.

DETAILED DESCRIPTION OF THE INVENTION

The invention provides a game having tokens that move along an infinite track and plural turntables disposed on the track, where motion of the turntables is coupled.

Figure 1:
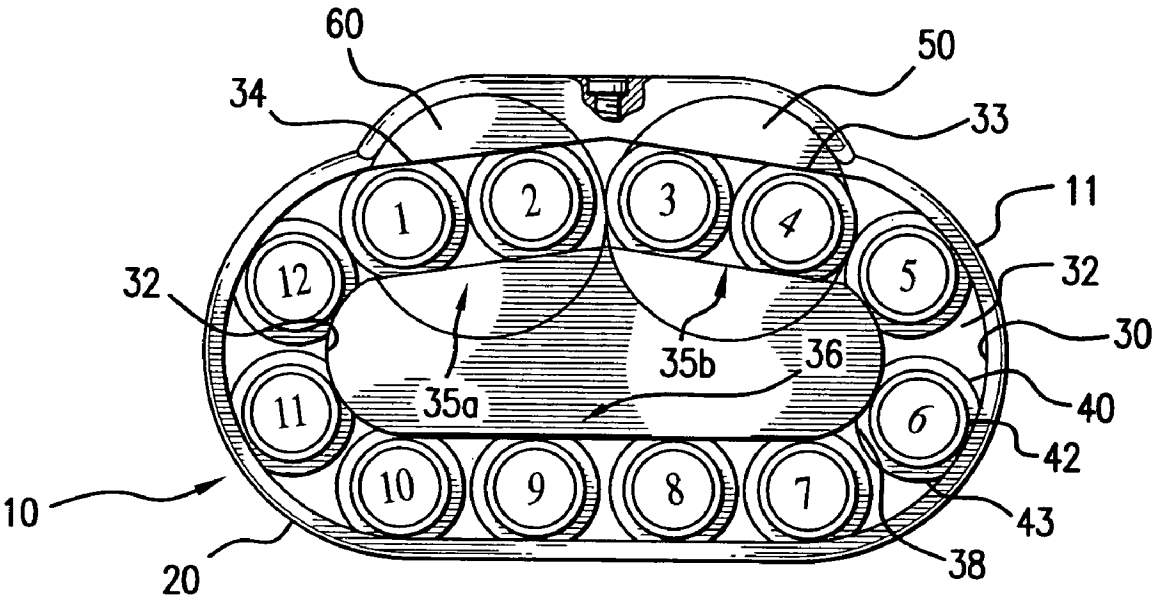
FIG. 1 is a top view of a first embodiment of the invention.
Figure 3:
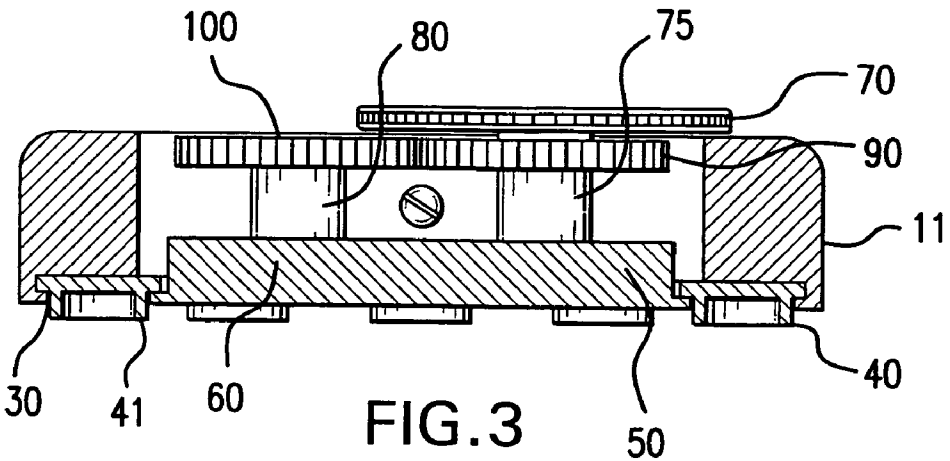
FIG. 3 is a cross sectional view of the first embodiment.
Figure 7:
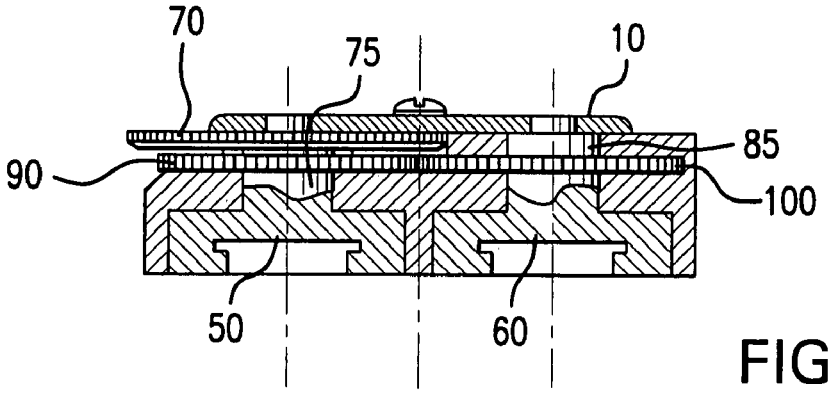
FIG. 7 is a cross sectional view of the second embodiment.

Turning to FIG. 1, a game 10 is disclosed. The game 10 includes a body 20. A track 30 is provided in the body 20 and plurality of tokens 40 are disposed along the track 30. The tokens 40 are capable of bidirectionally translating along the path of the track 30. As illustrated in FIGS. 3 and 7, the tokens 40 are disposed in the track 30 such that a top surface 41 of the tokens is above or alternatively planar with a top surface of the body 21.

Figure 2:
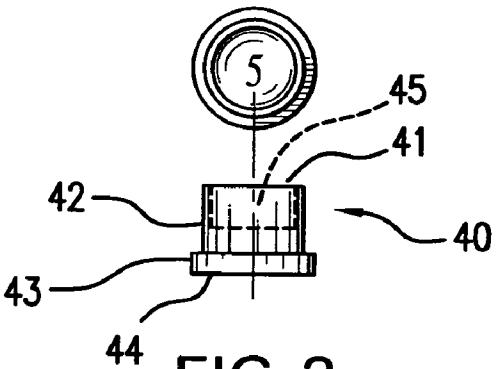
FIG. 2 is a token used in the first embodiment.

Turning to FIG. 2, each token 40 has a cylindrical cross sectional shape divided into a top cylindrical portion 42 and a bottom cylindrical portion 43. A top surface of the top cylindrical portion 42 is the top surface 41 of the token 40 and a bottom surface of the bottom cylindrical portion 43 is the bottom surface of the token 44.

The bottom cylindrical portion 43 has an outer diameter that is larger than an outer diameter of the top cylindrical portion 42 to enable the token 40 to remain in the track 30. As illustrated in FIG. 2, the diameter of the bottom cylindrical portion is 120% of the diameter of the top cylindrical portion 42. Furthermore, the top cylindrical portion 42 has an axial length that is greater than the axial length of the bottom cylindrical portion 43 to enable a user to contact the top of the token. As illustrated in FIG. 2, the axial length of the top cylindrical portion 42 is 300% of the axial length of the bottom cylindrical portion 43.

The diametrical and axial proportions of the token 40 are only one example of acceptable proportions. The only requirement is that the cross sectional shape of the track 30 mirror that of the token 40 so that the token 40 remains in the track 30 and is smoothly movable within the track 30 during use. Accordingly, the track 30 has opposing and radially extending lips 39*a* and 39*b* on radially outer and inner top edges of the track which extends over at least a portion of the bottom portion of the token 43. The tips 39*a* and 39*b* prevent the tokens 40 from falling out of the track 30 when the body is turned over by the user.

The top surface of each token 41 is defined by an insert 45 on which indicia is printed. The insert has an outer diameter that is 80% of the outer diameter of the top cylindrical portion of the token 42, has an axial length that is between 70% and 90% of the axial length of the top cylindrical portion 42, and is set to be flush with the top surface 41 of the top cylindrical portion of the token 42. Such a configuration assures that the inserts will permanently remain within the token 40 after being set with glue or other adhesive means.

The inserts may also be frictionally set to enable removal thereof and replacement therewith other indicia of interest to the player. For example, numbers are illustrated in the figure. However, another range of numbers, or letters or pictures may be used. Alternatively, the top surface of the token 41 may be printed with the indicia obviating the need to use an insert 45.

The track 30 is divided into a plurality of track portions including first, second and third track portions 32, 33, and 34. Each of the portions, 32, 33 and 34, has a same cross sectional shape and together provide the track 30 with an infinite, loop form. Each of the portions, 32, 33 and 34, is capable of receiving at least two tokens 40. It is illustrated that second and third portions 33 and 34 each fit two tokens an the first portion fits 8 tokens. Alternatively, the second portion 33 may contain a different number of tokens than the third portion 34.

Figure 5:
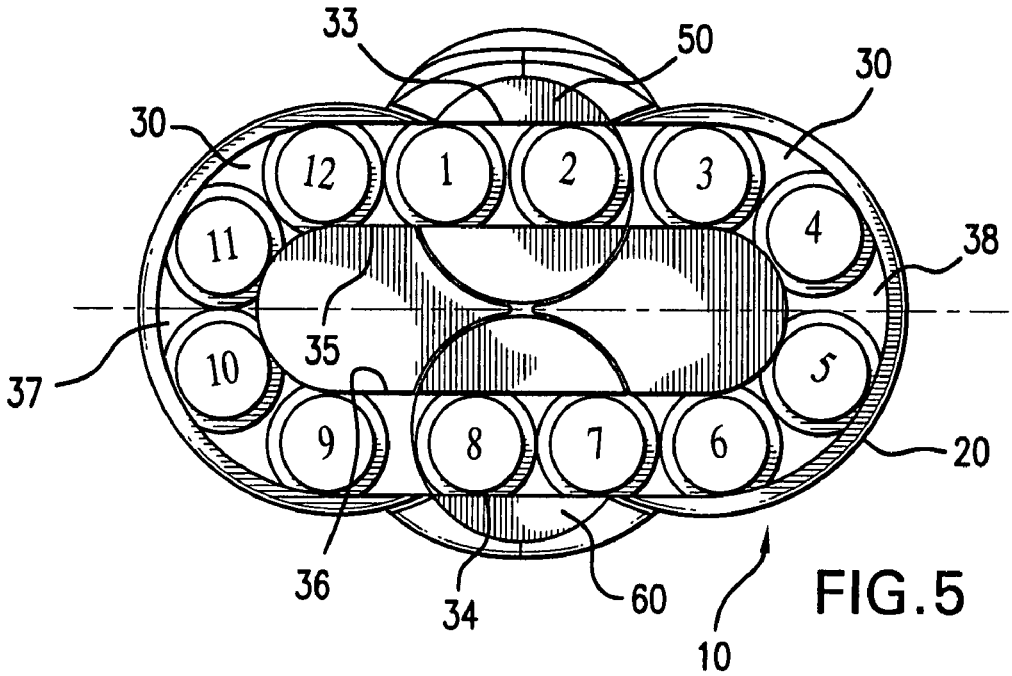
FIG. 5 is a top view of a second embodiment of the invention.
Figure 6:
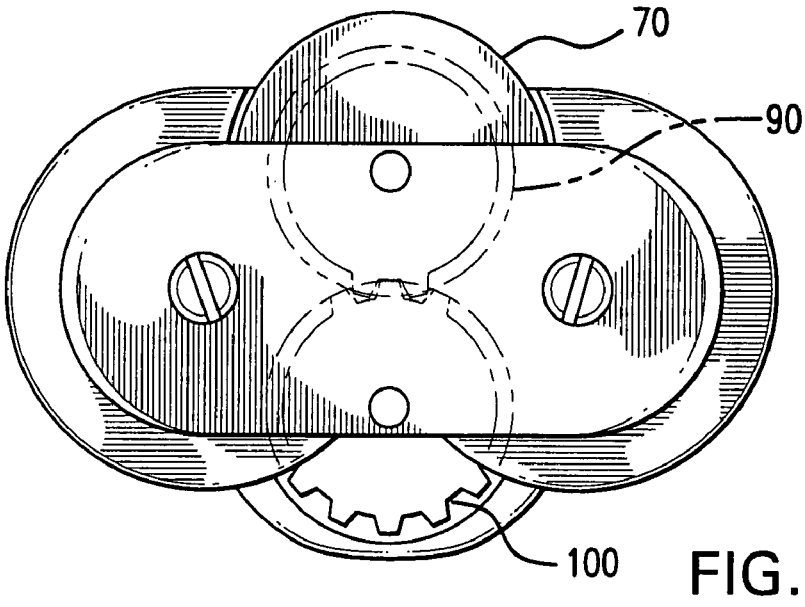
FIG. 6 is a bottom view of the second embodiment.

Referring to FIGS. 1 and 5, the track comprises an essentially oval shape, including opposing linear track segments 35 and 36 and opposing semi-circular sections 37 and 38. As illustrated, the first linear portion 35 consists of two linear portions 35*a* and 35*b* connected at an angle as shown in FIG. 1, but the two linear portions 35*a* and 35*b* can be a single, straight linear portion as illustrated in FIG. 5.

Referring to FIG. 1, the first and second track portions 33 and 34 are adjacently disposed on the first linear track portion 35. Alternatively, as illustrated in FIG. 5, the first and second track portions 33 and 34 are respectively disposed on ones of the opposing linear track segments 35 and 36. Yet alternatively, the first and second track portions 33 and 34 are respectively disposed on the first and second semi-circular track segments 37 and 38 (not illustrated).

The diameter of the semi-circular sections 37 and 38 is large enough to enable the tokens to translate therethough without becoming bound by friction. For example, the distance between the radial center of either section 37 or 38 to an inside of an outer surface 11 of the body 10 is twice the diameter of the bottom portion of the token 43.

The effective length of the track 30 is large enough to fit each token 40 and allow enough room between tokens 40 so that the tokens 40 do not become bound in place by frictional rubbing. Accordingly, where there are 12 tokens as provided in the illustrative example, the total length of the track is at least 1200% of the diameter of the bottom portion of the token 43.

The overall length of the body, between outer radial edges of the semi-circular sections 37 and 38, is illustrated as being over 600% of the diameter of the bottom portion 43 of the token 40. However, the length may increase or decrease so long as the tokens 40 are capable of traveling without becoming bound in the track 30.

According to the invention, a plurality of turntables, including first and second turntables, 50 and 60, containing tracks therein define respective ones of the first and second track portions 33 and 34. The turntables, 50 and 60, are rotatively coupled so that rotation of the first turntable 50 rotates both of the first and second turntables 50 and 60. From the rotation of the turntables, the order of tokens in the track portions 33 and 34 is simultaneously reversed.

Figure 4:
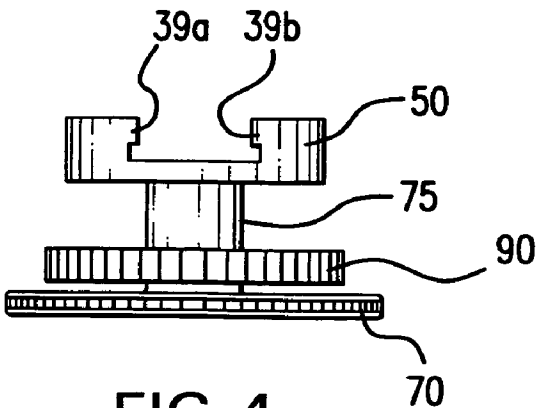
FIG. 4 is a view of a driving turntable of the first embodiment.

Turning to FIG. 4, the first turntable 50 includes a user operable grip 70 for enabling selective rotation of the first turntable 50. The grip 70 is in the form of a thumb wheel that is axially spaced from the first turntable 50. In the illustration, the grip 70 is illustrated as being mounted on a common shaft 75 with the turntable 50 and therefore rotates with a 1:1 ratio between the grip 70 and the first turntable 50. However, the grip 70 may be radially offset from the thumb wheel and may communicate therewith by, for example, a suitable geartrain and/or a chain drive and/or a belt drive.

As illustrated in FIG. 3, an axial distance between the grip 70 and the first turntable 50 is such that the grip 70 is axially spaced from a bottom face of the body 10. The grip 70 has a diameter that is larger than the first turntable 50 for providing easy access by the user. In an alternative embodiment, the grip 70 may be axially positioned within the body 10 as illustrated in FIG. 7 and have a diameter with a portion thereof extending beyond the body 10 for providing access to the user.

Each of the plurality of turntables, 50 and 60, comprises a respective first and second spur gear 90 and 100. The first gear 90 is attached to the first turntable 50 and is a pinion, or driving gear. The first gear 90 is attached to the first shaft 75 to coaxially rotate with the first shaft 75, the first turntable 50, and the grip 70.

The second gear 100 is attached to the second turntable 60 and meshes with and is driven by the first gear 90. The second gear 100 is attached to a second shaft 85 to coaxially rotate with the second shaft 85 and the second turntable 60. As illustrated in FIGS. 3 and 7, the body 10 represents a fixed link between the gears 90 and 100. Accordingly, in each of the embodiments illustrated in FIGS. 1 and 5, the gears are disposed on a single geartrain.

The driving gear 90 is illustrated in FIG. 4 as being disposed axially between the grip 70 and the first turntable 50. However, the driving gear 90 may be axially exterior to the grip 70 so long as the driving gear meshes with the driven gear 100.

Due to the geartrain relationship, the first gear 90 rotates in a first direction and the second gear 100 rotates in a second direction that opposes the first direction. Accordingly, if a user rotates the grip clockwise, the first gear will rotate clockwise and the second gear will rotate counterclockwise.

Alternatively, the geartrain can include a third gear between the first 90 and second gears 100 so that the first and second gears 90 and 100 rotate in a same direction. Accordingly, if a user rotates the grip 70 clockwise, the first and second gears 90 and 100 will rotate clockwise. Yet alternatively, if the grip 70 is spaced from the driving gear 90 by one or more intermediate gears, then the relative rotational motion will change as would be readily appreciated by one of ordinary skill.

In an alternative embodiment, instead of a geartrain, a base of each of the plurality of turntables comprises a sprocket, and each sprocket is driven by a common chain. Yet alternatively, a base of each of the plurality of turntables comprises a grooved sheave, and each sheave is driven by a common toothed belt.

When the grip 70 is removed from the location of the turntables 50 and 60, and the turntables are driven by either a belt drive, a chain drive, or a combination of three or more gears, smaller driving and driven components can used when manufacturing the game. As a result, the turntables 50 and 60 will not need to include complete circular profiles as can be appreciated by one skilled in the art so that, when the track portions 33 and 34 are in line with the infinite track 30, the exterior profile of the body can be completely oval. Furthermore, the placement of the turntables 50 and 60 on opposing cylindrical ends of the track 30 can be implemented in the oval body without the use of extensively large diameter driving and driven gears.

In a further alternative embodiment, a fourth track portion is provided that is capable of receiving at least two tokens and is rotatable independent of said first and second track portions for reversing an order of tokens the fourth track portion. The fourth track can be made rotatable by an individual grip member.

In the above embodiments and alternative embodiments, the geartrain and alternatives thereto and the grip together correspond to means for rotating the first and second track portions. With this rotating means, selective rotation of the first track portion automatically rotates the second track portion and simultaneously reverses the order of tokens in each of the first and second track portions.

The present invention may be embodied in other specific forms without departing from its spirit or essential characteristics. The described embodiments are to be considered in all respects only as illustrative and not as restrictive. The scope of the invention is, therefore, indicated by the appended claims and their combination in whole or in part rather than by the foregoing description. All changes that come within the meaning and range of equivalency of the claims are to be embraced within their scope.

The invention claimed is:

1. A game comprising:

a body, a track disposed in said body, tokens disposed in said track, the tokens capable of translating in the track;

said track including a plurality of track portions including first, second and third track portions, each of the plurality of portions being capable of receiving at least two tokens;

a plurality of turntables including first and second turntables each supporting a respective one of said first and second track portions;

the turntables being rotatably coupled together so that rotation of said first turntable rotates both said first track portion and said second turntable, thereby automatically rotating said second track portion and simultaneously reversing an order of tokens in each of said first and second track portions with respect to the third track portion; and the tack comprising an oval shape, including opposing first and second linear track segments and opposing first and second semicircular sections.

2. The game of claim 1, wherein the first and second track portions are adjacently disposed on one of said first and second linear track segments.

3. The game of claim 1, wherein the first and second track portions are respectively disposed on said first and second linear track segments.

4. The game of claim 1, wherein the first and second track portions are respectively disposed on said first and second semi-circular track segments.

5. The game of claim 1, wherein the first turntable includes a user operable grip for enabling selective rotation thereof.

6. The game of claim 5, wherein a base of each of the plurality of turntables comprises a gear, the first turntable having a driving gear, the second turntable having a driven gear, and the body being a fixed link, and the gears being disposed on a single geartrain.

7. The game of claim 6 wherein said first gear rotates in a first direction and said second gear rotates in a second direction that opposes said first direction.

8. The game of claim 6 wherein said first and second gears rotate in a same direction.

9. A game comprising:

a body, a track disposed in said body, tokens disposed in said track, the tokens capable of translating in the track;

the track including a plurality of track portions including first, second and third track portions, each of the plurality of portions being capable of receiving at least two tokens;

means for rotating said first and second track portions, wherein selective rotation of said first track portion automatically rotates said second track portion and simultaneously reversing an order of tokens in each of said first and second track portions;

the track comprising an oval shape, including opposing first and second linear track segments and opposing first and second semicircular sections.

10. The game of claim 9, wherein the first and second track portions are adjacently disposed on one of said first and second linear track segments.

11. The game of claim 9, wherein the first and second track portions are respectively disposed on said first and second linear track segments.

12. The game of claim 9, wherein the first and second track portions are respectively disposed on said first and second semi-circular track segments.

13. The game of claim 9, wherein the first track portion includes a user operable grip for enabling selective rotation thereof.

14. The game of claim 13, wherein the first track portion includes a driving gear, the second track portion includes a driven gear, and the body is a fixed link, and the gears are disposed on a single geartrain.

15. The game of claim 14 wherein said first gear rotates in a first direction and said second gear rotates in a second direction that opposes said first direction.

16. The game of claim 14 wherein said first and second gears rotate in a same direction.

17. A game comprising:

a body;

a track disposed in said body;

tokens disposed in said track, the tokens being configured to be movable along the track;

said track being configured to define a continuous closed circuit course such that travel of a token in one direction along said course from a starting point will return the token to the starting point;

said track including first, second and third track portions, each configured to hold at least two tokens and each forming a portion of said course;

said first and second track portions being rotatably supported on said body such that positions of first and second ends of each respective one of said first and second track portions are interchangeable by rotation of said first and second track portions;

said third track portion being fixed relative said body;

said first and second track portions being rotatively coupled to each other so that rotation of said first track portion rotates said second track portion such that said first and second track portions are simultaneously rotated and reverse, with respect to the third track portion, an order of tokens in each of said first and second track portions; and said first and second track portions being configured such that said first and second ends of each respective one of said first and second track portions are positionable via rotation of said first and second track portions to effect the continuous closed circuit course.

18. The game of claim 17 wherein:

said first and second track portions are respectively supported on first and second turntables supported rotatably by said body;

each of said first and second track portions respectively traverse said first and second turntables so as to intersect circumferential peripheries of said first and second turntables at two locations corresponding to said first and second ends of each of said first and second track portions.

19. The game of claim 18, wherein the first turntable includes a driving gear, the second turntable includes a driven gear, and the gears are disposed on a single geartrain.

20. The game of claim 19 wherein the geartrain is configured such that said first gear rotates in a first direction and said second gear rotates in a second direction that opposes said first direction.

* * * * *